US010051390B2

(12) United States Patent
Link et al.

(10) Patent No.: US 10,051,390 B2
(45) **Date of Patent: *Aug. 14, 2018**

(54) HEARING AID ADAPTED FOR EMBEDDED ELECTRONICS

(71) Applicant: Starkey Laboratories, Inc., Eden Prairie, MN (US)

(72) Inventors: Douglas F. Link, Plymouth, MN (US); David Prchal, Hopkins, MN (US); Sidney A. Higgins, Maple Grove, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/595,302

(22) Filed: May 15, 2017

(65) Prior Publication Data

US 2017/0318402 A1 Nov. 2, 2017

Related U.S. Application Data

(63) Continuation of application No. 14/257,537, filed on Apr. 21, 2014, now Pat. No. 9,654,887, which is a continuation of application No. 12/539,195, filed on Aug. 11, 2009, now Pat. No. 8,705,785.

(60) Provisional application No. 61/087,899, filed on Aug. 11, 2008.

(51) Int. Cl.
*H04R 25/00* (2006.01)

(52) U.S. Cl.
CPC ..... *H04R 25/604* (2013.01); *H04R 25/60* (2013.01); *H04R 25/65* (2013.01)

(58) Field of Classification Search
CPC ..... H04R 25/60; H04R 25/65; H04R 25/604; H04R 25/652
USPC ..... 381/312–330; 29/594
See application file for complete search history.

(56) References Cited

U.S. PATENT DOCUMENTS

| | | | |
|---|---|---|---|
| 2,327,320 | A | 8/1943 | Shapiro |
| 3,728,509 | A | 4/1973 | Shimojo |
| 3,812,300 | A | 5/1974 | Brander et al. |
| 4,017,834 | A | 4/1977 | Cuttill et al. |
| 4,310,213 | A | 1/1982 | Fetterolf, Sr. et al. |
| 4,564,955 | A | 1/1986 | Birch et al. |

(Continued)

FOREIGN PATENT DOCUMENTS

| | | |
|---|---|---|
| DE | 1247402 | 8/1967 |
| DE | 3006235 A1 | 10/1980 |

(Continued)

OTHER PUBLICATIONS

"U.S. Appl. No. 10/894,576, Non-Final Office Action dated Jul. 2, 2007", 12 pgs.

(Continued)

*Primary Examiner* — Sunita Joshi
(74) *Attorney, Agent, or Firm* — Schwegman Lundberg & Woessner, P.A.

(57) ABSTRACT

A hearing aid comprising a microphone, a receiver, hearing aid electronics coupled to the microphone and the receiver, and conductive traces overlaying an insulator, the conductive traces configured to interconnect the hearing aid electronics and to follow non-planar contours of the insulator. Examples are provided wherein the insulator includes a hearing aid housing.

18 Claims, 3 Drawing Sheets

(56) References Cited

U.S. PATENT DOCUMENTS 4,571,464 A 2/1986 Segero
4,729,166 A 3/1988 Lee et al.
5,606,621 A 2/1997 Reiter et al.
5,640,457 A 6/1997 Gnecco et al.
5,687,242 A 11/1997 Iburg
5,708,720 A 1/1998 Meyer
5,740,261 A 4/1998 Loeppert et al.
5,755,743 A 5/1998 Volz et al.
5,802,183 A 9/1998 Scheller et al.
5,824,968 A 10/1998 Packard et al.
5,825,894 A 10/1998 Shennib
5,987,146 A 11/1999 Pluvinage et al.
6,031,923 A 2/2000 Gnecco et al.
6,167,138 A 12/2000 Shennib
6,563,045 B2 5/2003 Goett et al.
6,766,030 B1 7/2004 Chojar
6,876,074 B2 4/2005 Kim
6,985,598 B1 1/2006 Joschika
7,003,127 B1 2/2006 Sjursen et al.
7,016,512 B1 3/2006 Feeley et al.
7,065,224 B2 6/2006 Cornelius et al.
7,110,562 B1 9/2006 Feeley et al.
7,139,404 B2 11/2006 Feeley et al.
7,142,682 B2 11/2006 Mullenborn et al.
7,181,035 B2 2/2007 Van Halteren et al.
7,256,747 B2 8/2007 Victorian et al.
7,320,832 B2 1/2008 Palumbo et al.
7,354,354 B2 4/2008 Palumbo et al.
7,446,720 B2 11/2008 Victorian et al.
7,460,681 B2 12/2008 Geschiere et al.
7,471,182 B2 12/2008 Kumano et al.
7,593,538 B2 9/2009 Polinske
7,720,244 B2 5/2010 Espersen et al.
8,098,863 B2 1/2012 Ho et al.
8,103,039 B2 1/2012 Van Halteren et al.
8,116,495 B2 2/2012 Spaulding
8,259,975 B2 9/2012 Bally et al.
8,295,517 B2 10/2012 Gottschalk et al.
8,385,573 B2 2/2013 Higgins
8,494,195 B2 7/2013 Higgins
8,638,965 B2 1/2014 Higgins et al.
8,705,785 B2 4/2014 Link et al.
8,781,141 B2 7/2014 Higgins et al.
8,798,299 B1 8/2014 Higgins et al.
8,861,761 B2 10/2014 Higgins
8,908,895 B2 12/2014 Würfel
9,049,526 B2 6/2015 Higgins
9,654,887 B2 5/2017 Link et al.
9,693,154 B2 6/2017 Higgins et al.
2002/0061113 A1 5/2002 Van Halteren et al.
2002/0074633 A1* 6/2002 Larson ..... H01L 25/16 257/678
2002/0131614 A1 9/2002 Jakob et al.
2003/0178247 A1 9/2003 Saltykov
2003/0200820 A1 10/2003 Takad et al.
2004/0010181 A1 1/2004 Feeley et al.
2004/0028251 A1 2/2004 Kasztelan et al.
2004/0114776 A1 6/2004 Crawford et al.
2004/0240693 A1 12/2004 Rosenthal
2005/0008178 A1 1/2005 Joergensen et al.
2005/0111685 A1 5/2005 Gabathuler
2006/0008110 A1 1/2006 Van Halteren
2006/0018495 A1 1/2006 Geschiere et al.
2006/0078142 A1 4/2006 Neilson
2006/0097376 A1* 5/2006 Leurs ..... H01L 23/4985 257/690
2006/0159298 A1 7/2006 Von Dombrowski et al.
2007/0009130 A1 1/2007 Feeley et al.
2007/0014423 A1 1/2007 Darbut et al.
2007/0036374 A1 2/2007 Bauman et al.
2007/0121979 A1 5/2007 Zhu et al.
2007/0147630 A1 6/2007 Chiloyan
2007/0188289 A1 8/2007 Kumano et al.
2007/0248234 A1 10/2007 Ho et al.
2008/0003736 A1 1/2008 Arai et al.
2008/0026220 A9 1/2008 Bi et al.
2008/0187157 A1* 8/2008 Higgins ..... H04R 25/00 381/314
2008/0199971 A1 8/2008 Tondra
2008/0260193 A1 10/2008 Westermann et al.
2009/0074218 A1 3/2009 Higgins
2009/0075083 A1 3/2009 Bi et al.
2009/0196444 A1 8/2009 Solum
2009/0245558 A1 10/2009 Spaulding
2009/0252365 A1 10/2009 Lin
2009/0262964 A1 10/2009 Havenith et al.
2010/0034410 A1 2/2010 Douglas et al.
2010/0074461 A1 3/2010 Polinske
2010/0124346 A1 5/2010 Higgins
2010/0135513 A1 6/2010 Geschiere et al.
2010/0158291 A1 6/2010 Polinske et al.
2010/0158293 A1 6/2010 Polinske et al.
2010/0158295 A1 6/2010 Polinske et al.
2011/0044485 A1 2/2011 Lin et al.
2012/0014549 A1 1/2012 Higgins et al.
2012/0263328 A1 10/2012 Higgins
2013/0230197 A1 9/2013 Higgins
2014/0355803 A1 12/2014 Higgins et al.
2015/0086051 A1 3/2015 Link et al.
2015/0163601 A1 6/2015 Higgins
2017/0359662 A1 12/2017 Higgins et al.

FOREIGN PATENT DOCUMENTS

DE 3502178 A1 8/1985
DE 3643124 A1 7/1988
DE 4005476 A1 7/1991
DE 9320391 U1 9/1993
DE 4233813 C1 11/1993
DE 9408054 U1 5/1994
DE 29801567 U1 5/1998
DE 102008045668 A1 9/2008
EP 0339877 A3 11/1989
EP 0424916 B1 7/1995
EP 0866637 A2 9/1998
EP 1065863 A2 1/2001
EP 1209948 A2 5/2002
EP 1465457 A2 10/2004
EP 1496530 A2 1/2005
EP 1209948 A3 7/2006
EP 1811808 A1 7/2007
EP 1816893 A1 8/2007
EP 1850630 A2 10/2007
EP 1916561 A2 4/2008
EP 1916561 A3 4/2008
EP 1920634 B1 2/2009
EP 2040343 A1 3/2009
EP 2107829 B1 5/2012
EP 2509341 A1 10/2012
EP 2160047 B1 10/2013
EP 2509341 B1 6/2014
GB 1298089 11/1972
GB 1522549 8/1978
GB 1522549 B3 8/1978
JP 2209967 A 8/1990
JP 2288116 A 11/1990
JP 09199662 A 7/1997
WO WO-9741710 A1 11/1997
WO WO-0079832 A2 12/2000
WO WO-0143497 A1 6/2001
WO WO-2004025990 A1 3/2004
WO WO-06094502 A1 9/2006
WO WO-2006094502 A1 9/2006
WO WO-2007027152 A1 3/2007
WO WO-2007112404 A2 10/2007
WO WO-2007112404 A3 10/2007
WO WO-2007140403 A2 12/2007
WO WO-2007140403 A3 12/2007
WO WO-2007148154 A1 12/2007
WO WO-2008092265 A1 8/2008
WO WO-2008097600 A1 8/2008
WO WO-2008097600 C1 8/2008
WO WO-2011101041 A1 8/2011

(56) References Cited

FOREIGN PATENT DOCUMENTS

OTHER PUBLICATIONS

"U.S. Appl. No. 10/894,576, Non-Final Office Action dated Dec. 18, 2007", 11 pgs.
"U.S. Appl. No. 10/894,576, Notice of Allowance dated Aug. 5, 2008", 7 pgs.
"U.S. Appl. No. 10/894,576, Response filed Apr. 18, 2008 to Non-Final Office Action dated Dec. 18, 2007", 10 pgs.
"U.S. Appl. No. 10/894,576, Response filed Oct. 1, 2007 to Non-Final Office Action dated Jul. 2, 2007", 10 pgs.
"U.S. Appl. No. 11/857,439, Final Office Action dated Feb. 29, 2012", 16 pgs.
"U.S. Appl. No. 11/857,439, Non Final Office Action dated Aug. 17, 2011", 16 pgs.
"U.S. Appl. No. 11/857,439, Notice of Allowance dated May 30, 2012", 9 pgs.
"U.S. Appl. No. 11/857,439, Notice of Allowance dated Sep. 19, 2012", 9 pgs.
"U.S. Appl. No. 11/857,439, Response filed Apr. 30, 2012 to Final Office Action dated Feb. 29, 2012", 9 pgs.
"U.S. Appl. No. 11/857,439, Response filed Jun. 13, 2011 to Restriction Requirement dated May 11, 2011", 8 pgs.
"U.S. Appl. No. 11/857,439, Response filed Dec. 17, 2011 to Non Final Office Action dated Aug. 17, 2011", 12 pgs.
"U.S. Appl. No. 11/857,439, Restriction Requirement dated May 11, 2011", 6 pgs.
"U.S. Appl. No. 12/027,173, Final Office Action dated Dec. 8, 2011", 12 pgs.
"U.S. Appl. No. 12/027,173, Non Final Office Action dated Jul. 11, 2011", 10 pgs.
"U.S. Appl. No. 12/027,173, Non Final Office Action dated Jul. 27, 2012", 11 pgs.
"U.S. Appl. No. 12/027,173, Notice of Allowance dated Mar. 19, 2013", 8 pgs.
"U.S. Appl. No. 12/027,173, Response filed Jun. 8, 2012 to Final Office Action dated Dec. 8, 2011", 7 pgs.
"U.S. Appl. No. 12/027,173, Response filed Nov. 14, 2011 to Non Final Office Action dated Jul. 11, 2011", 8 pgs.
"U.S. Appl. No. 12/027,173, Response filed Dec. 26, 2012 to Non Final Office Action dated Jul. 27, 2012", 8 pgs.
"U.S. Appl. No. 12/059,578, Notice of Allowance dated Oct. 5, 2011", 8 pgs.
"U.S. Appl. No. 12/325,838, Non Final Office Action dated Jun. 16, 2011", 5 pgs.
"U.S. Appl. No. 12/539,195, Advisory Action dated Apr. 23, 2013", 3 pgs.
"U.S. Appl. No. 12/539,195, Final Office Action dated Feb. 11, 2013", 15 pgs.
"U.S. Appl. No. 12/539,195, Non Final Office Action dated Jul. 20, 2012", 13 pgs.
"U.S. Appl. No. 12/539,195, Non Final Office Action dated Aug. 2, 2013", 14 pgs.
"U.S. Appl. No. 12/539,195, Notice of Allowance dated Nov. 29, 2013", 12 pgs.
"U.S. Appl. No. 12/539,195, Response filed Apr. 11, 2013 to Final Office Action dated Feb. 11, 2013", 7 pgs.
"U.S. Appl. No. 12/539,195, Response filed Nov. 4, 2013 to Non Final Office Action dated Aug. 2, 2013", 7 pgs.
"U.S. Appl. No. 12/539,195, Response filed Dec. 20, 2012 to Non Final Office Action dated Jul. 20, 2012", 7 pgs.
"U.S. Appl. No. 12/548,051, Final Office Action dated Apr. 19, 2012", 12 pgs.
"U.S. Appl. No. 12/548,051, Non Final Office Action dated Jan. 24, 2013", 12 pgs.
"U.S. Appl. No. 12/548,051, Non Final Office Action dated Oct. 12, 2011", 11 pgs.
"U.S. Appl. No. 12/548,051, Notice of Allowance dated Jul. 31, 2013", 14 pgs.
"U.S. Appl. No. 12/548,051, Response filed Jan. 12, 2012 to Non Final Office Action dated Oct. 12, 2011", 9 pgs.
"U.S. Appl. No. 12/548,051, Response filed Apr. 24, 2013 to Non Final Office Action dated Jan. 24, 2013", 8 pgs.
"U.S. Appl. No. 12/548,051, Response filed Sep. 19, 2012 to Final Office Action dated Apr. 19, 2012", 8 pgs.
"U.S. Appl. No. 12/644,188, Advisory Action dated Jul. 25, 2013", 3 pgs.
"U.S. Appl. No. 12/644,188, Final Office Action dated May 22, 2013", 7 pgs.
"U.S. Appl. No. 12/644,188, Non Final Office Action dated Sep. 9, 2013", 9 pgs.
"U.S. Appl. No. 12/644,188, Non Final Office Action dated Sep. 19, 2012", 8 pgs.
"U.S. Appl. No. 12/644,188, Notice of Allowance dated Mar. 21, 2014", 5 pgs.
"U.S. Appl. No. 12/644,188, Response filed Feb. 19, 2013 to Non Final Office Action dated Sep. 19, 2012", 6 pgs.
"U.S. Appl. No. 12/644,188, Response filed Jul. 22, 2013 to Final Office Action dated May 22, 2013", 6 pgs.
"U.S. Appl. No. 12/644,188, Response filed Dec. 9, 2013 to Non Final Office Action dated Sep. 9, 2013", 6 pgs.
"U.S. Appl. No. 12/842,305, Examiner Interview Summary dated Apr. 19, 2013", 3 pgs.
"U.S. Appl. No. 12/842,305, Non Final Office Action dated Jan. 17, 2014", 8 pgs.
"U.S. Appl. No. 12/842,305, Response filed Apr. 8, 2013 to Restriction Requirement dated Feb. 8, 2013", 6 pgs.
"U.S. Appl. No. 12/842,305, Response filed Apr. 17, 2014 to Non Final Office Action dated Jan. 17, 2014", 9 pgs.
"U.S. Appl. No. 12/842,305, Restriction Requirement dated Feb. 8, 2013", 6 pgs.
"U.S. Appl. No. 13/181,752, Final Office Action dated Jul. 11, 2013", 7 pgs.
"U.S. Appl. No. 13/181,752, Non Final Office Action dated Mar. 5, 2013", 7 pgs.
"U.S. Appl. No. 13/181,752, Notice of Allowance dated Sep. 25, 2013", 9 pgs.
"U.S. Appl. No. 13/181,752, Response filed Jun. 5, 2013 to Non Final Office Action dated Mar. 5, 2013", 8 pgs.
"U.S. Appl. No. 13/181,752, Response filed Sep. 11, 2013 to Final Office Action dated Jul. 11, 2013", 8 pgs.
"U.S. Appl. No. 13/422,177, Advisory Action dated Jun. 9, 2014", 3 pgs.
"U.S. Appl. No. 13/422,177, Final Office Action dated Feb. 27, 2014", 12 pgs.
"U.S. Appl. No. 13/422,177, Non Final Office Action dated Jul. 16, 2014", 12 pgs.
"U.S. Appl. No. 13/422,177, Non Final Office Action dated Sep. 26, 2013", 10 pgs.
"U.S. Appl. No. 13/422,177, Notice of Allowance dated Feb. 3, 2015", 8 pgs.
"U.S. Appl. No. 13/422,177, Response filed Apr. 28, 2014 to Final Office Action dated Feb. 27, 2014", 9 pgs.
"U.S. Appl. No. 13/422,177, Response filed Oct. 16, 2014 to Non Final Office Action dated Jul. 16, 2014", 10 pgs.
"U.S. Appl. No. 13/422,177, Response filed Dec. 20, 2013 to Non Final Office Action dated Sep. 26, 2013", 8 pgs.
"U.S. Appl. No. 13/776,557, Final Office Action dated Mar. 20, 2014", 8 pgs.
"U.S. Appl. No. 13/776,557, Non Final Office Action dated Oct. 22, 2013", 6 pgs.
"U.S. Appl. No. 13/776,557, Notice of Allowance dated Jun. 13, 2014", 8 pgs.
"U.S. Appl. No. 13/776,557, Response dated Jan. 22, 2014 to Non Final Office Action dated Oct. 22, 2013", 6 pgs.
"U.S. Appl. No. 13/776,557, Response filed May 15, 2014 to Final Office Action dated Mar. 20, 2014", 7 pgs.
"U.S. Appl. No. 14/257,537, Advisory Action dated Jul. 14, 2016", 6 pgs.
"U.S. Appl. No. 14/257,537, Advisory Action dated Oct. 21, 2015", 2 pgs.

(56) References Cited

OTHER PUBLICATIONS

"U.S. Appl. No. 14/257,537, Appeal Brief filed Oct. 27, 2016", 15 pgs.
"U.S. Appl. No. 14/257,537, Decision dated Aug. 15, 2016 on Pre-Appeal Brief Request filed Jul. 27, 2016", 4 pgs.
"U.S. Appl. No. 14/257,537, Final Office Action dated Apr. 27, 2016", 20 pgs.
"U.S. Appl. No. 14/257,537, Final Office Action dated Aug. 3, 2015", 16 pgs.
"U.S. Appl. No. 14/257,537, Non Final Office Action dated Mar. 19, 2015", 19 pgs.
"U.S. Appl. No. 14/257,537, Non Final Office Action dated Nov. 17, 2015", 20 pgs.
"U.S. Appl. No. 14/257,537, Pre-Appeal Brief Request filed Jul. 27, 2016", 4 pgs.
"U.S. Appl. No. 14/257,537, Response filed Feb. 17, 2016 to Non Final Office Action dated Nov. 17, 2015", 19 pgs.
"U.S. Appl. No. 14/257,537, Response filed Jun. 19, 2015 to Non Final Office Action dated Mar. 19, 2015", 6 pgs.
"U.S. Appl. No. 14/257,537, Response filed Jun. 27, 2016 to Final Office Action dated Apr. 27, 2016", 8 pgs.
"U.S. Appl. No. 14/257,537, Response filed Oct. 5, 2015 to Final Office Action dated Aug. 3, 2015", 8 pgs.
"U.S. Appl. No. 14/257,537, Response filed Nov. 3, 2015 to Advisory Action dated Oct. 21, 2015", 8 pgs.
"U.S. Appl. No. 14/301,103, Advisory Action dated Jun. 10, 2016", 3 pgs.
"U.S. Appl. No. 14/301,103, Final Office Action dated Mar. 25, 2016", 11 pgs.
"U.S. Appl. No. 14/301,103, Non Final Office Action dated Dec. 2, 2015", 9 pgs.
"U.S. Appl. No. 14/301,103, Non-Final Office Action dated Jul. 28, 2016", 10 pgs.
"U.S. Appl. No. 14/301,103, Notice of Allowance dated Feb. 15, 2017", 8 pgs.
"U.S. Appl. No. 14/301,103, Preliminary Amendment filed Jul. 1, 2014", 5 pgs.
"U.S. Appl. No. 14/301,103, Response filed Mar. 2, 2016 to Non Final Office Action dated Dec. 2, 2015", 6 pgs.
"U.S. Appl. No. 14/301,103, Response filed May 25, 2016 to Final Office Action dated Mar. 25, 2016", 7 pgs.
"U.S. Appl. No. 14/301,103, Response filed Oct. 28, 2016 to Non-Final Office Action dated Jul. 28, 2016", 6 pgs.
"U.S. Appl. No. 14/512,560, Non Final Office Action dated Jan. 29, 2016", 9 pgs.
"U.S. Appl. No. 15/632,742, Preliminary Amendment filed Sep. 5, 2017", 6 pgs.
"European Application Serial No. 12167845.2, Extended EP Search Report dated Sep. 12, 2012", 6 pgs.
"European Application Serial No. 08253065.0, European Examination Notification dated Oct. 11, 2011", 7 pgs.
"European Application Serial No. 08253065.0, European Office Action dated Aug. 26, 2010", 6 Pgs.
"European Application Serial No. 08253065.0, Extended Search Report dated Dec. 15, 2008", 9 pgs.
"European Application Serial No. 08253065.0, Office Action dated Jul. 17, 2009", 1 pg.
"European Application Serial No. 08253065.0, Response filed Jan. 16, 2010 to Office Action dated Jul. 17, 2009", 9 pgs.
"European Application Serial No. 08253065.0, Response filed Feb. 8, 2012 to Examination Notification dated Oct. 11, 2011", 15 pgs.
"European Application Serial No. 08253065.0, Response to Office Action filed Feb. 28, 2011 to European Office Action dated Aug. 26, 2010", 17 pgs.
"European Application Serial No. 08725262.3, EPO Written Decision to Refuse dated Oct. 19, 2012", 14 pgs.
"European Application Serial No. 08725262.3, Office Action dated Apr. 21, 2010", 6 Pgs.
"European Application Serial No. 08725262.3, Office Action dated Aug. 5, 2011", 5 pgs.
"European Application Serial No. 08725262.3, Response filed Feb. 13, 2012 to Office Action dated Aug. 5, 2011", 11 pgs.
"European Application Serial No. 08725262.3, Response filed Nov. 2, 2010 to Office Action dated Apr. 21, 2010", 14 pgs.
"European Application Serial No. 08725262.3, Summons to Attend Oral Proceedings dated Jun. 6, 2012", 5 pgs.
"European Application Serial No. 09168844.0, European Search Report dated Apr. 19, 2010", 3 Pgs.
"European Application Serial No. 09168844.0, Office Action dated Apr. 8, 2013", 5 pgs.
"European Application Serial No. 09168844.0, Office Action dated Apr. 28, 2011", 5 pgs.
"European Application Serial No. 09168844.0, Office Action dated May 14, 2012", 2 pgs.
"European Application Serial No. 09168844.0, Office Action dated May 3, 2010", 5 pgs.
"European Application Serial No. 09168844.0, Response filed Feb. 24, 2012 to Office Action dated Apr. 28, 2011", 12 pgs.
"European Application Serial No. 09168844.0, Response filed Jul. 24, 2012 to Examination Notification Art. 94(3) dated May 14, 2012", 10 pgs.
"European Application Serial No. 09168844.0, Response filed Nov. 15, 2010 to Office Action dated May 3, 2010", 8 pgs.
"European Application Serial No. 09250729.2, Extended Search Report dated Dec. 14, 2009", 4 pgs.
"European Application Serial No. 10251319.9, Office Action dated Jan. 3, 2012", 6 pgs.
"European Application Serial No. 10251319.9, Response filed Jul. 24, 2012 to Extended European Search Report dated Jan. 3, 2012", 10 pgs.
"European Application Serial No. 12160102.5, Extended European Search Report dated Sep. 7, 2016", 8 pgs.
"European Application Serial No. 12167845.2, Response filed Apr. 10, 2013 to Extended European Search Report dated Sep. 12, 2012", 14 pgs.
"European Application Serial No. 09168844.0, Office Action dated Sep. 4, 2012", 4 pgs.
"European Application Serial No. 09168844.0, Response filed Mar. 14, 2013 to Office Action dated Sep. 4, 2012", 34 pgs.
"International Application Serial No. PCT/US2008/001609, International Preliminary Report on Patentability dated Aug. 20, 2009", 10 pgs.
"International Application Serial No. PCT/US2008/001609, Search Report dated Jun. 19, 2008", 7 pgs.
"International Application Serial No. PCT/US2008/001609, Written Opinion dated Jun. 19, 2008", 8 pgs.
Buchoff, L S, "Advanced Non-Soldering Interconnection", Electro International, 1991 (IEEE), XP 10305250A1, (1991), 248-251.
P, "U.S. Appl. No. 14/257,537, Notice of Allowance dated Jan. 13, 2017", 10 pgs.
Tondra, Mark, "Flow Assay With Integrated Detector", U.S. Appl. No. 60/887,609, filed Feb. 1, 2007, 28 pgs.
"U.S. Appl. No. 15/632,742, Non Final Office Action dated Feb. 7, 2018", 11 pgs.

* cited by examiner

HEARING AID ADAPTED FOR EMBEDDED ELECTRONICS

PRIORITY AND RELATED APPLICATIONS

The application is a continuation of U.S. application Ser. No. 14/257,537, filed Apr. 21, 2014, is a continuation of U.S. application Ser. No. 12/539,195, filed Aug. 11, 2009, now issued as U.S. Pat. No. 8,705,785, which application claims the benefit of priority under 35 U.S.C. 119(e) of U.S. Provisional Patent Application Ser. No. 61/087,899, filed Aug. 11, 2008, which application are incorporated herein by reference in their entirety.

TECHNICAL FIELD

The present subject matter relates generally to hearing assistance devices and housings and in particular to method and apparatus for integration of electrical components with hearing assistance device housings.

BACKGROUND

Hearing assistance device manufacturers, including hearing aid manufacturers, have adopted thick film hybrid technologies that build up layers of flat substrates with semiconductor die and passive electronic components attached to each substrate. Manufacturing of such circuits employ technologies, such as, surface mount, flip-chip, or wire-bond that interconnect the various die. Conductors such as wires or flex circuits are attached to pads on the hybrid module after the hybrid module is assembled and tested. The conductors connect various electro-mechanical, electro-acoustical and electro-chemical devices to the active electronics within the hybrid. Connection points may be provided for a battery, receiver/speaker, switch, volume control, microphones, programming interface, external audio interface and wireless electronics including an antenna. Recent advances, such as the addition of wireless technology, have stressed designers' ability to accommodate additional advances using expanded hybrid circuits because of size limitations within a device housing. Growing the hybrid to add features, functions and new interfaces, increases the overall size and complexity of a hearing instrument. Expanding the current hybrid may not be a viable option since the hybrid circuit is made up of finite layers of rectangular planes. The larger, complex circuits compete with most manufacturers' goals of small and easy to use hearing assistance devices and hearing aids.

SUMMARY

The present subject matter relates to hearing aids comprising a microphone, a receiver, hearing aid electronics coupled to the microphone and the receiver and a conductive traces integrated with an insulator, the conductive traces adapted to interconnect the hearing aid electronics and to follow non-planar contours of the insulator. In some examples, the insulator includes a hearing aid housing and components of the hearing aid electronics embedded in the hearing aid housing. In some examples, the insulator includes a connector plug to connect a transducer to the hearing aid electronics. In some examples, the connector plug includes an embedded electrical device.

This Summary is an overview of some of the teachings of the present application and not intended to be an exclusive or exhaustive treatment of the present subject matter. Further details about the present subject matter are found in the detailed description and appended claims. The scope of the present subject matter is defined by the appended claims and their legal equivalents.

DETAILED DESCRIPTION

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

The present subject matter provides apparatus and methods for using conductor on insulator technology to provide space saving, robust and consistent electronic assemblies. Although applicable to various types of electronics and electronic devices, examples are provided for hearing assistance devices. In various applications, the insulator is a plastic. In various applications the insulator is a ceramic. Other insulators are possible without departing from the scope of the present subject matter.

Figure 1A:
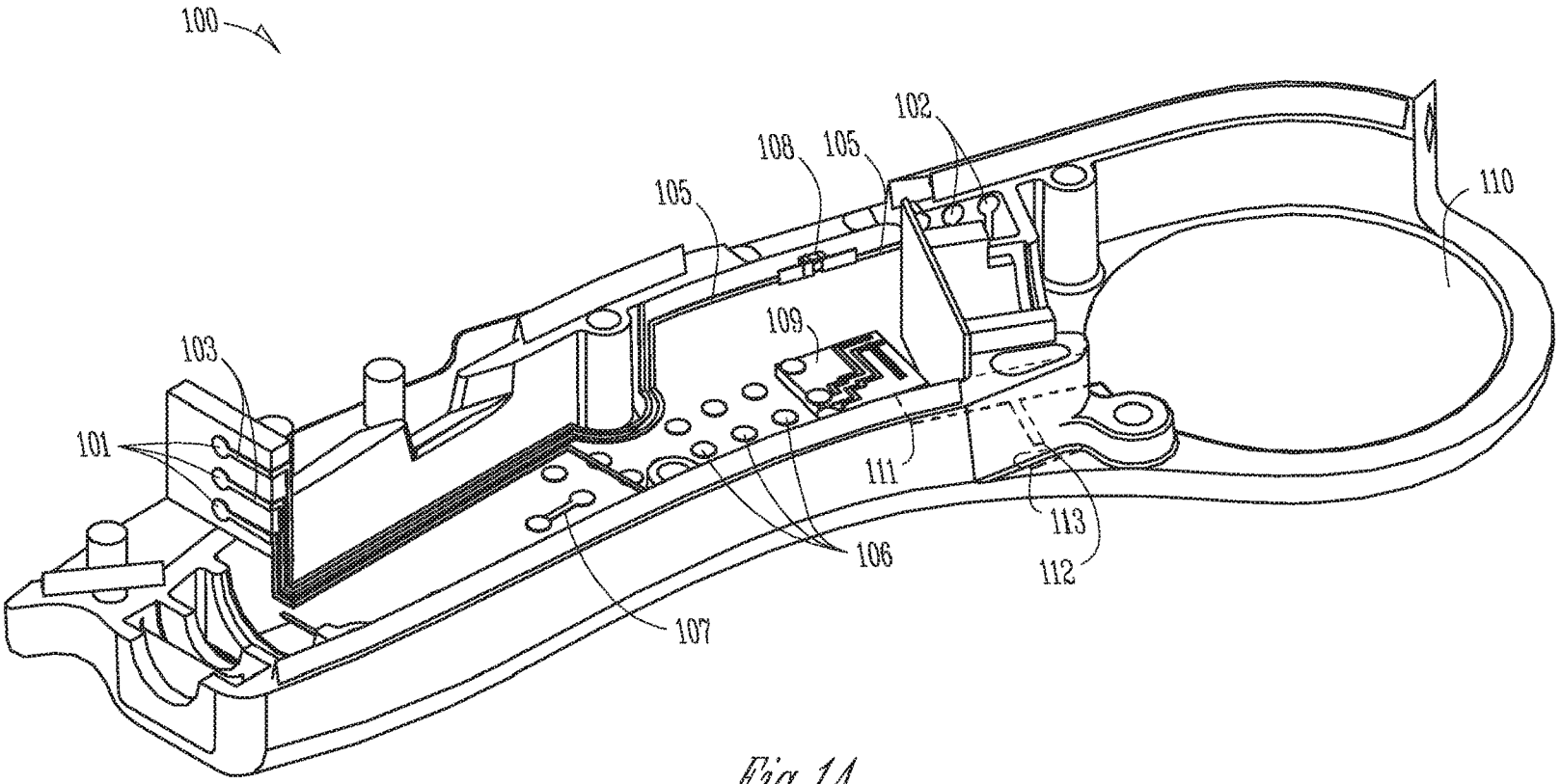
FIG. 1A illustrates a portion of a hearing assistance device housing according to one embodiment of the present subject matter.

FIG. 1A illustrates a portion 100 of a hearing assistance device housing 100 according to one embodiment of the present subject matter. The illustrated housing portion includes a number of conductor-on-insulator (COI) applications. Example applications of COI traces visible in FIG. 1 are contact pads 101, 102 and multi axis traces 103, connected to the contact pads 101. The multi axis traces 103 follow the tight contours of the housing and eliminate the need for bonding wires, a separate substrate, or both, to connect, for example, a transducer or a switch, to the hearing assistance electronics. In various embodiments, electrical components, such as transducers, sensors switches and surface mounted electronics, connect to the contact pads 101, 102 using conductive silicone. Conductive silicone reduces the need for solder and makes the replacement and service of electrical components in the hearing assistance device more efficient.

Figure 1B:
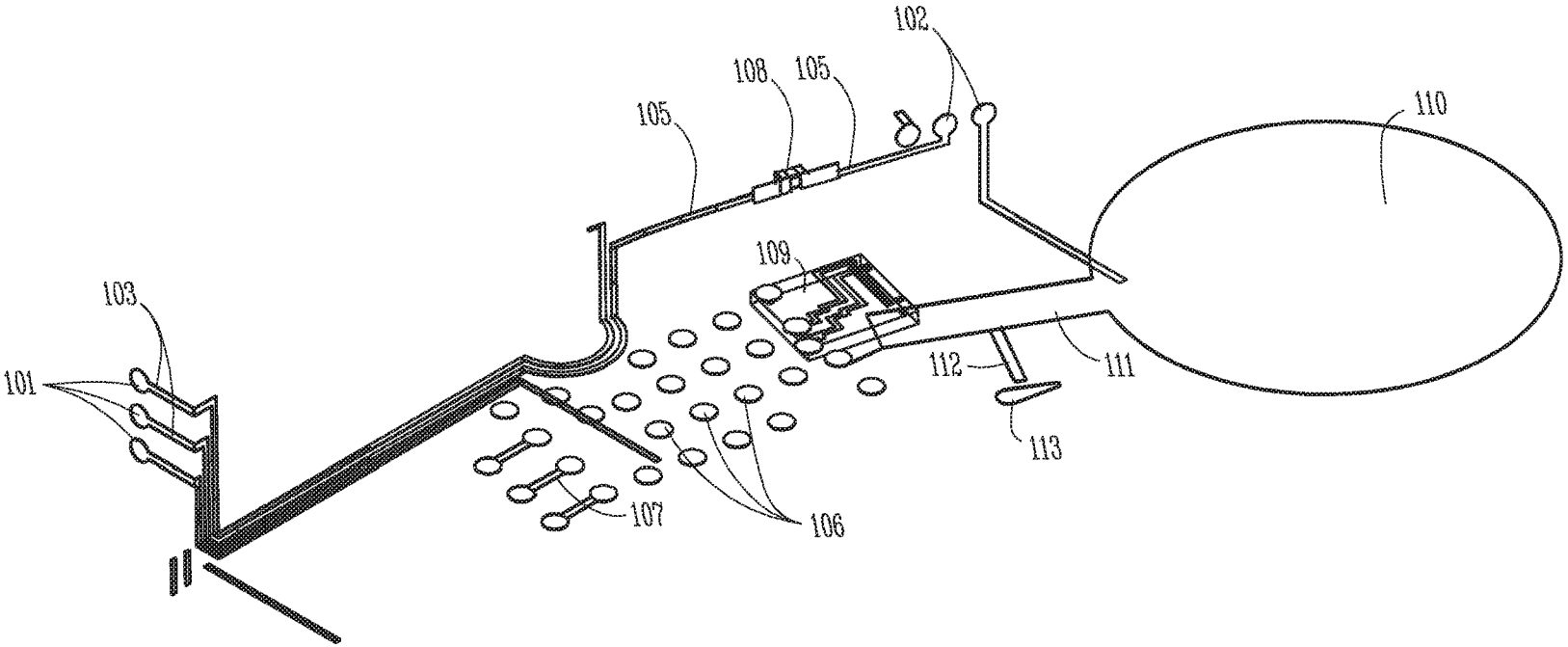
FIG. 1B shows a three dimensional view of the COI technologies present in the hearing assistance device housing of FIG. 1A according to one embodiment of the present subject matter without the plastic housing portion.

In the illustrated embodiment, portions of COI traces 105 lead to an integrated capacitor (see for example capacitor 108 on FIG. 1B). Integrating electrical components, such as passive components, with the housing of the hearing assistance device frees up area within the housing and provides additional design freedom to modify the size of the device or add additional features. It is understood that other integrated passive electrical components are possible without departing from the scope of the present subject matter.

This approach also allows the integration of ball grid array component bond pads 106 and connecting traces 107 with the device housing as demonstrated in FIG. 1A. The COI bond pads 106 and traces 107 reduce the need for an additional substrate and bond wires, thus freeing up space within the housing. Such designs can provide for one or more of: smaller housings, additional features, more streamlined manufacturing processes, and/or more consistent performance of the electronics of the device.

FIG, 1B shows a three dimensional view of the COI technologies present in the hearing assistance device housing of FIG. 1A without the plastic housing portion. FIG. 1B includes the multi axis traces 103 and bond pads 101, 102 integrated with the sidewalls of the housing. FIG. 1B also shows the position of the integrated capacitor 108 discussed above and the traces 105 connected to the capacitor. Additional bonding pads 106 for a ball grid array (BGA) component or other surface mounted electronics are illustrated in FIG. 1B. FIG. 1B demonstrates some additional options for design, including, but not limited to, an active component 109 integrated into the device housing, a large bonding pad 110 and distribution trace 111 for a battery, and an intercavity conductor 112 and contact pad 113. In one embodiment, active component 109 is a flip chip semiconductor die. Other design options are possible, and those shown herein are intended to demonstrate only some options and are not intended to be an exhaustive or exclusive set of design options.

Figure 2A:
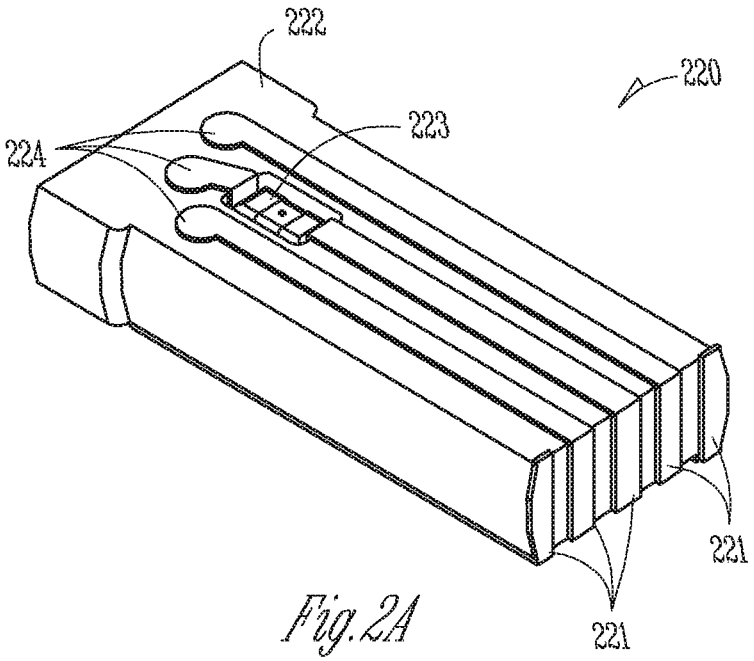
FIGS. 2A and 2B demonstrate various views of a COI application for components according to one embodiment of the present subject matter.
Figure 2B:
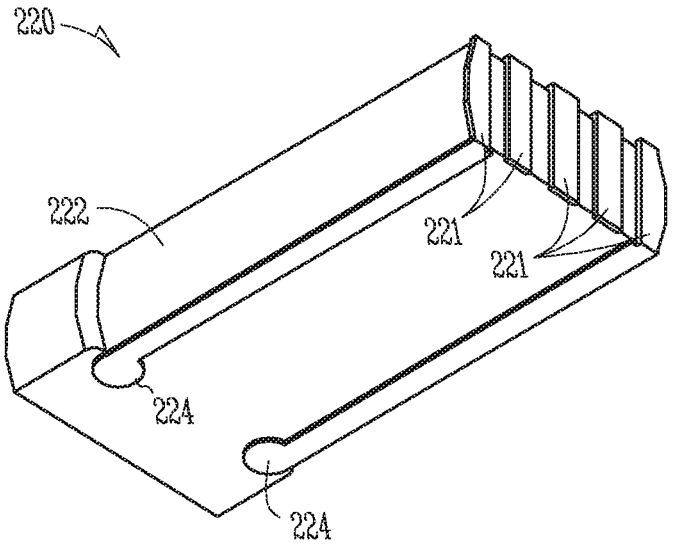

FIGS. 2A and 2B demonstrate various views of a COI application for components. In the example of FIGS. 2A and 2.B a plug for a hearing assistance device is coated with conductive traces. In one embodiment, the plug is used with a receiver-in-the-canal (RIC) application, such as RIC plug 220. The plug includes a number of conductive traces 221 integrated with the plastic body 222. The illustrated plug is used to connect an OTE or BTE type housing to a RIC device. In this embodiment, the plug includes five (5) traces 221 and contact pads 224 to connect both a receiver (2 traces) and a microphone (3 traces). In the design shown, discrete components, such as a DC blocking capacitor 223 is integrated with the body of the plug. Available space of the plug is better utilized by embedding the passive component 223, in this example a microphone DC blocking capacitor. Integrating components, such as surface mounted electronics, into the plug body frees up volume within the housing of the hearing assistance device. The component 223 can be placed into a cavity with a connector or can be otherwise integrated into the connector using a variety of technologies. The capacitor 223 can either be placed into a cavity within a connector or the capacitor can be completely embedded within the connector using various technologies known in the art. For example, a technology called Microscopic integrated Processing Technology (MIPTEC) available from Panasonic integrates 3-dimensional conductive elements about the surface of various injection molded components. The process includes molding one or more articles, thinly metalizing one or more surfaces using sputter deposition, for example, laser etching conductor patterns in the metallization layer, electroplating the conductors with copper, etching to remove excess metallization material and then electroplating additional conductive material such as nickel and aluminum to form the finished conductors. The process is used to form 3-dimensional conductive traces on plastic and ceramic insulators. Additional technologies, including various Molded Interconnect Device (MID) technologies, are available for integrating and embedding electrical circuit and circuit components with a housing, including, but not limited to, the process described in U.S. Patent Publication 2006/0097376, Leurs, et al., and incorporated by reference herein in its entirety.

Referring again to FIGS. 2A and 2B, in various embodiments, a hearing assistance system includes two plugs. One plug connects wires to the receiver, or RIC device, and the other connects the wires to the housing enclosing the hearing assistance electronics. In various embodiments, conductive silicone is used to electrically connect the plug with the corresponding circuits in a mated connector.

For hearing assistance devices, COI technology provides some benefits including, but not limited to, one or more of: tightly controlled and consistent radio frequency (RF) characteristics due to consistent circuit placement; reduced feedback and/or repeatable feedback performance due to precise transducer lead location; efficient production with substantially fewer manufacturing steps including elimination of manual soldering, wire routing, and related, traditional electronic assembly operations, smaller hearing instruments; possible elimination of wires; possible elimination of the traditional PCB or thick film ceramic substrate; and possibly smaller and/or less expensive hearing instrument components. Such components include, but are not limited to RIC connectors, DAI modules, capacitive switches, or antenna modules, Examples of hearing assistance device designs benefiting from COI technologies include, but are not limited to, behind-the-ear (BTE) and over-the-ear (OTE) designs as well as the faceplates of in-the-ear (ITE), in-the-canal (ITC) and completely-in-the-canal (CIC) designs. Any hearing assistance device housing and/or connectors can benefit from the teachings provided herein. In a hearing assistance device housing, for example, DSP, memory, and RF semiconductor dies can be flip chip attached and integrated with the hearing instrument housing or spine along with passive components, battery contacts, interconnecting conductor traces, RF antenna, and transducer connectors to reduce the assembly process of the hearing assistance device.

It will be understood by those of ordinary skill in the art, upon reading and understanding the present subject matter that COI technology includes, but is not limited to, conductor-on-plastic (COP) or conductor-on-ceramic (COC) processes, for example. Technologies have been developed, as discussed above, which enable formation of conductive patterns either on or embedded within uniquely shaped plastic or ceramic substrates. Such processes facilitate production of electronic assemblies or components integrated with uniquely shaped plastic or ceramic substrate structures.

The present subject matter includes hearing assistance devices, including, but not limited to, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in-the-canal. It is understood that other hearing assistance devices not expressly stated herein may fall within the scope of the present subject matter.

This application is intended to cover adaptations and variations of the present subject matter. It is to be understood that the above description is intended to be illustrative, and not restrictive. The scope of the present subject matter should be determined with reference to the appended claim, along with the full scope of equivalents to which the claims are entitled.

What is claimed is:

1. A hearing aid comprising:

a microphone;

a receiver;

hearing aid electronics coupled to the microphone and the receiver; and conductive traces overlaying an insulator, the conductive traces provided using Molded Interconnect Device (MID) technology and configured to interconnect the hearing aid electronics and to follow non-planar contours of the insulator, wherein the insulator includes a hearing aid housing and wherein the hearing aid housing includes a plurality of internal cavities and the conductive traces include an inter-cavity trace configured to electrically interconnect hearing aid electronics disposed within at least two different cavities of the hearing aid housing.

2. The hearing aid of claim 1, wherein the hearing electronics include a plurality of electronic devices, and wherein an electronic device of the plurality of electronic devices is embedded in the insulator and coupled to one or more of the conductive traces.

3. The hearing aid of claim 2, wherein the electronic device includes a passive surface mount device.

4. The hearing aid of claim 2, wherein the electronic device includes an active device.

5. The hearing aid of claim 2, further comprising conductive silicone to couple the electronic device to the one or more conductive traces.

6. The hearing aid of claim 1, comprising a contact pad trace array integrated with the insulator, the contact pad trace array having a contact array pattern coupled to the conductive traces and configured to receive an electrical component having a ball grid array (BGA) type packaging.

7. The hearing aid of claim 1, wherein the insulator includes plastic.

8. The hearing aid of claim 1, wherein the insulator includes ceramic.

9. The hearing aid of claim 1, wherein the hearing aid housing is a behind-the-ear housing.

10. The hearing aid of claim 1, wherein the hearing aid housing is an in-the-ear housing.

11. The hearing aid of claim 1, wherein the hearing aid housing is an in-the-canal housing.

12. The hearing aid of claim 1, wherein the hearing aid housing is a completely-in-the-canal housing.

13. A method of manufacturing a hearing aid, the method comprising:

providing a housing for the hearing aid, the housing including integrated electrical components embedded within a sidewall of the housing; and providing multi-axis conductive traces along contours of the sidewall of the housing using Molded Interconnect Device (MID) technology, the conductive traces overlaying an insulator and following non-planar contours of the insulator, the conductive traces configured to connect the integrated electrical components to hearing aid electronics within the housing using the conductive traces, wherein the housing includes a plurality of internal cavities and the conductive traces include an inter-cavity trace configured to electrically interconnect hearing aid electronics disposed within at least two different cavities of the housing.

14. The method of claim 13, wherein the integrated electronic components include a passive surface mount device.

15. The method of claim 13, wherein the integrated electronic components includes an active device.

16. The method of claim 13, further comprising integrating a contact pad trace array with the insulator, the contact pad trace array having a contact array pattern coupled to the conductive traces and configured to receive an electrical component having a ball grid array (BGA) type packaging.

17. The method of claim 13, wherein the insulator includes plastic.

18. The method of claim 13, wherein the insulator includes ceramic.

* * * * *